United States Patent [19]

Fink

[11] 4,451,695

[45] May 29, 1984

[54] CONNECTOR ASSEMBLY

[75] Inventor: Richard R. Fink, Basking Ridge, N.J.

[73] Assignee: Heyman Manufacturing Co., Kenilworth, N.J.

[21] Appl. No.: 369,238

[22] Filed: Apr. 16, 1982

[51] Int. Cl.[3] ..... H01R 4/12

[52] U.S. Cl. ..... 174/87; D13/26

[58] Field of Search ..... 174/87; D13/26; 403/214

[56] References Cited

U.S. PATENT DOCUMENTS

| | | | |
|---|---|---|---|
| 2,890,266 | 6/1959 | Bollmeier | 174/87 |
| 3,097,257 | 7/1963 | Cheney | 174/87 |
| 3,119,896 | 1/1964 | Vogel | 174/87 |
| 3,156,761 | 11/1964 | Schinske | 174/87 |
| 3,297,816 | 1/1967 | Waddington | 174/87 |
| 3,347,979 | 10/1967 | Hoffman | 174/87 |
| 3,440,335 | 4/1969 | Blomstrand | 174/87 |
| 3,448,223 | 6/1969 | Thorsman | 174/87 |
| 3,676,574 | 7/1972 | Johansson et al. | 174/87 |
| 4,227,040 | 10/1980 | Scott | 174/87 |

FOREIGN PATENT DOCUMENTS

| | | | |
|---|---|---|---|
| 2388422 | 12/1978 | France | 174/87 |

*Primary Examiner*—J. V. Truhe
*Assistant Examiner*—Morris H. Nimmo
*Attorney, Agent, or Firm*—Auslander & Thomas

[57] ABSTRACT

A connector assembly for metallic wires comprises a tapered spring coil member made from stiff elastic wire having a distended end at the apex and a thermoplastic member having an elongated shell with a central bore closed at one end by a wall and having on the other end a substantially circular opening. The inside of the bore is substantially tapered such as to be adapted to house the tapered spring coil member. Two recesses are provided in the tapered inside wall of the thermoplastic member running on opposite sides substantially parallel to the central axis of the bore for providing a locking position to the distended end of the inserted spring coil member. A protrusion near the open end of the thermoplastic member retains the tapered spring coil member inside of the thermoplastic member. The thermoplastic member preferably on its outside forms a frustrum of a cone with, in addition, two substantially conical section planes being provided to allow for easy gripping of the connector assembly.

11 Claims, 9 Drawing Figures

FIG. 5
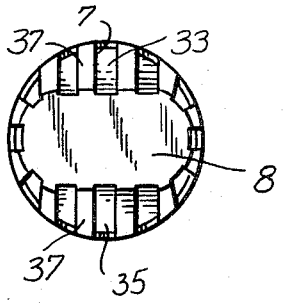
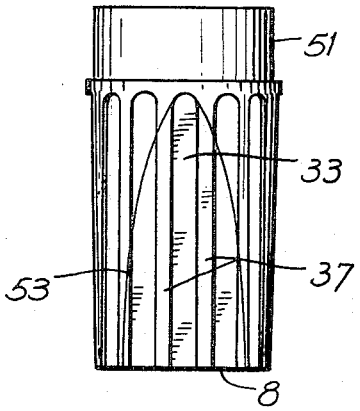
FIG. 7
FIG. 8
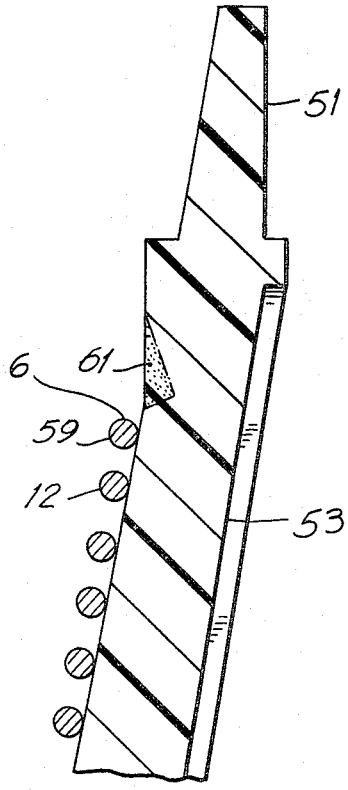
FIG. 9
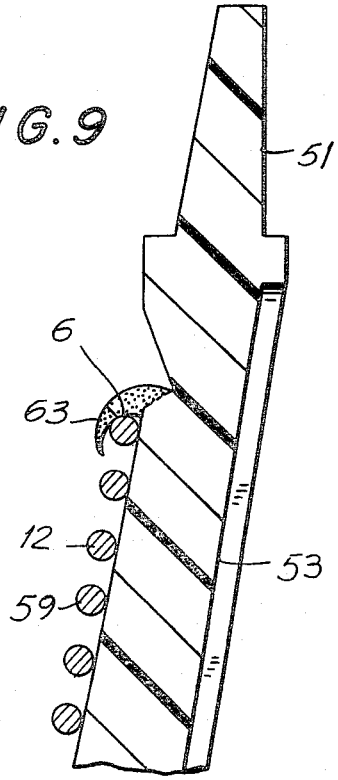

CONNECTOR ASSEMBLY

BACKGROUND OF THE INVENTION

The present invention relates to a connector assembly for metallic wires which comprises a tapered spring coil member disposed in a thermoplastic member.

Various connector assemblies are known in the art. Schinske in U.S. Pat. No. 3,075,038 teaches a connector assembly, where the end of the wire of a spring coil may be extended slightly or pulled away from the normal turns of the coil. Schinske in U.S. Pat. No. 3,001,002 teaches a screw-on connector, where the end of the coil may be extended slightly or pulled away from the normal turns of the coil and an abutment next to the apex of the coil can be provided in or as an integral part of the shell to function as a shoulder or anchor for the end of the coil. Schinske in U.S. Pat. No. 3,156,761 teaches a connector assembly, where the end of the wire of a spring coil may be distended slightly or pulled away from the normal turns of the coil as shown and an abutment is provided in the shell, preferably but not necessarily integrated with the side walls and end wall to provide a shoulder or anchor for this end of the coil. In certain situations the insulating cap may have to be heated so that it will expand while the spring is inserted and contract when it cools to hold the spring in. Schinske in U.S. Pat. No. 3,113,553 teaches a connector with indicator where an abutment is placed to engage the end of the large turn 16 of the coil 15.

Cheney in U.S. Pat. No. 3,097,257 teaches an electrical connector where the end of the coil may be extended slightly or pulled away from the normal turns of the coil and an abutment may be provided in or as an integral part of the shell or cap to function as a shoulder or anchor for the end of the coil. Scott in U.S. Pat. No. 4,227,040 teaches a screw-on electrical connector where the spring or coil may be held or retained in the bore of the connector by an upset or dam which may be circumferentially continuous or in segments, as desired. Bollmeier in U.S. Pat. No. 2,890,266 teaches a wire connector where each of the ends of the shell is slotted as shown to produce internal angular recesses having sides against which the tips of the helix may press.

Hoffman in U.S. Pat. No. 3,347,979 teaches an electrical connector with audible indicator means where during counter-clockwise rotation of an assembly the end is held against relative rotation by reason of a spring being held through an end in engagement with a face provided. Waddington in U.S. Pat. No. 3,297,816 teaches a connector for electrical conductors where the spring may be inserted initially to snap past the narrow neck position and will be then positioned interiorly of the body portion and held against accidental displacement. Waddington et al. in U.S. Pat. No. 3,875,324 disclose a wire connector where the housing includes a lip projecting into the cavity adjacent the first end of the spring member within the cavity prior to the rotational installation. Thorsman in U.S. Pat. No. 3,448,223 teaches a clamp for connecting electrical wires where the lower end of the spring projects tangentially from the lowermost spring coil and in inserted position is placed close to the sleeve bottom of one of the grooves.

The extent of the art shows that there have been numerous attempts to provide a connector assembly where a tapered spring coil is held within a thermoplastic member. However, some of these teachings are expensive to produce or have undesirable features related to their application.

OBJECTS AND SUMMARY OF THE INVENTION

Accordingly, it is an object of the present invention to provide a connector assembly for metallic wires wherein a tapered spring coil of stiff wire is mechanically held in position to prevent removal of the tapered spring coil from the thermoplastic member during application.

More specifically, it is an object to provide a connector assembly for metallic wires where one end of the tapered spring coil of stiff wire is held in a fixed angular position to allow for tightening of the tapered spring coil around the wires to be connected.

It is a further object of the invention to provide a method for producing connector assemblies for metallic wires from tapered spring coil members and from thermoplastic members adapted to hold tapered spring coils.

According to one aspect of the invention there is provided a connector assembly for metallic wires which comprises a tapered spring coil member of stiff wire having a distended end at its apex projecting to the outside of the tapered spring coil member in a direction about in a plane vertical to the tapered spring coil axis. A thermoplastic member is produced from thermoplastic material and has an elongated shell with a central bore, the bore having two ends, the bore closed at one end by an end wall and open at its other end, the bore opening substantially circular, the inside of the bore is substantially tapered and is adapted to house the tapered spring coil member. There are two recesses in the tapered inside wall of the bore, the recesses are disposed substantially beginning nearest to the largest diameter of the bore taper and the recesses run about within a plane passing through the central axis of the bore. The recesses are adapted to provide space and guidance during insertion and locking for the distended end of the tapered spring coil member. A protrusion is provided near the bore opening, the protrusion adapted to retain the tapered spring coil member at its wide base end and to prevent the tapered spring coil member from falling out of the bore.

According to a feature of the invention the end wall of the bore has a substantially elongated form wherein the general shape of the outside wall of the thermoplastic member near the closed end wall substantially corresponds to the surface generated by straight lines connecting the substantially circular bore opening and the elongated form of the end wall such that a form is provided for the thermoplastic member, which can be easily gripped.

Preferably, the thermoplastic member is formed from a thermoplastic material such as nylon. The longest dimension of the elongated form corresponds to nearly the diameter of the substantially circular opening. The elongated form of the outside wall near the closed end wall can substantially correspond to two semicircles disposed in a plane connected by straight connecting lines. The tapered spring coil can have a conical taper and the central bore of the thermoplastic member can have a conical taper. The protrusion can be a frozen weld line, which preferably is generated by ultrasonic welding. The protrusion can retain the tapered spring coil member in a fixed position or, alternatively, in a loose position. Preferably, no more than two recesses are provided in the inside of the thermoplastic member.

The tensile strength of the thermoplastic material in the area of the protrusion can be from about 10 to 50 percent less than in the bulk of the thermoplastic member. The brittleness of the material in the area of the protrusion can be from about 10 to 50 percent higher than in the bulk of the thermoplastic member. The protrusion can be a ring inside the thermoplastic member disposed at a position distant from the open end of the thermoplastic member by from about 0.1 to 0.3 times the total length of the thermoplastic member. Preferably, the thermoplastic member exhibits substantially mm2 symmetry according to the international nomenclature.

In a further aspect of the present invention there is provided a method for producing a connector assembly for metallic wires which comprises producing a tapered spring coil member having a distended end at its apex projecting to the outside of the spring coil member about within a plane vertical to the tapered spring coil member's axis, vibrating the tapered spring coil member to place it into an oriented position, molding a thermoplastic member from thermoplastic resin, vibrating the thermoplastic member to place the member into an oriented position, inserting the oriented tapered spring coil member into the thermoplastic member and ultrasonically welding part of the thermoplastic member to produce a protrusion for retaining the tapered spring coil member within the thermoplastic member. The stability of the tapered spring coil member can be tested after it is inserted into the thermoplastic member.

Preferably, an oriented thermoplastic member is placed on an indexing table and the indexing table is rotated before the step of inserting the tapered spring coil member into the thermoplastic member and again before ultrasonically welding part of the thermoplastic member to provide a protrusion for retaining the tapered spring coil member in the thermoplastic member. The protrusion can be produced as an inner circle on the inside of the thermoplastic member near the open end.

The invention provides as an advantage that the tapered spring coil member is fixed in its position by the protruding end engaging one of the grooves of the thermoplastic member. Further, the tapered spring coil member is retained by a protrusion provided by welding whereby separation of the tapered spring coil member from the thermoplastic member is prevented.

Furthermore, based on the symmetry of the thermoplastic member with the two grooves, the outside of the thermoplastic member can have the symmetry mm2 and thereby follow the symmetry on the inside for producing two faces at which the connector assembly for metallic wires can be gripped or handled.

The above, and other objects, features and advantages of the present invention will become apparent from the following description read in conjunction with the accompanying drawings, in which like reference numerals designate the same elements.

BRIEF DESCRIPTION OF THE DRAWINGS

FIG. 5 is a top view onto the closed end of the thermoplastic member.

FIG. 7 is a side elevational view of the thermoplastic member.

FIG. 8 is a sectional detail view of the area to be welded.

FIG. 9 is a sectional detail view of the area around the produced weld line.

DETAILED DESCRIPTION OF THE PREFERRED EMBODIMENT

Figure 1:
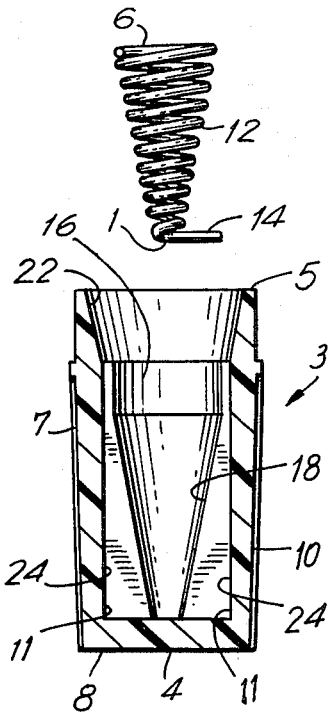
FIG. 1 is a sectional view of a tapered spring coil member and of a thermoplastic member before assembly.
Figure 2:
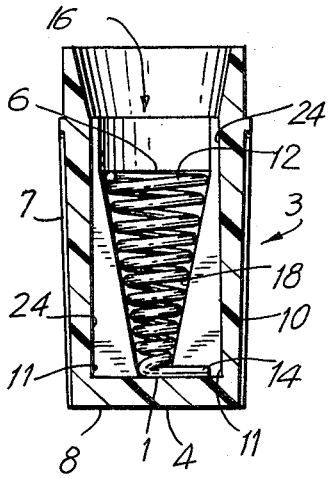
FIG. 2 is a sectional view of the tapered spring coil member as inserted into the thermoplastic member.

In accordance with the present invention, a wire connector assembly 3 is provided where a tapered spring coil member 12 is held in a thermoplastic member 10. The tapered spring coil member 12 preferably has a conical shape and is made from a stiff elastic wire. The metallic spring wire can be steel wire and is preferably coated or plated with a corrosion resistant material. Referring now to FIG. 1, at the apex 1 of the tapered spring coil member 12, the end 14 of the stiff elastic wire is distended and protrudes into a plane vertical to the axis of the tapered spring coil member 12. The length of the distended end 14 is preferably from about 0.2 to 1 times the largest diameter of the coil windings.

Preferably, the spring coil member 12 is wound clockwise, starting from its base 6 when viewed as the spring coil member 12 is inserted into the conical cavity 16 of the thermoplastic member 10 with the apex 1 going into the cavity 16 first. Wires (not shown) inserted into the complete wire connector assembly 3 follow a continuous path so that they can be screwed into the spring coil member 12 and follow the continuous path when the wire connector assembly 3 is rotated clockwise as the wire connector assembly 3 is viewed from apex 4 of the thermoplastic member 10 toward its base 5. When the spring coil member 12 is held in fixed position by its end 14 and the wires to be connected are inserted into it, the clockwise rotation of the wire connector assembly 3, as mentioned above, will open the spring coil member 12 while the wires move further into the inside of the spring coil member 12.

The thermoplastic member 10 is adapted to surround the tapered spring coil member 12. As in case of a conical spring coil member 12, the thermoplastic member 10 is provided with a substantially conical cavity 16 adapted to match the outside of the spring coil member 12.

The inner part of the thermoplastic member 10 to surround the spring coil member 12 is provided with two grooves 24 each extended in parallel to the axial direction of the central bore of the thermoplastic member 10 at the bore center and disposed on two opposed inner sides of the thermoplastic member 10. The grooves 24 are preferably dimensioned such that the bottoms 11 of the grooves 24 are about parallel to each other. The depth of the grooves 24 is such that the projecting end 14 of the spring coil member 12 can be moved through one of the grooves during insertion of the spring coil member 12 and further can rest in the groove 24 at its end upon full insertion of the spring coil member 12 into the thermoplastic member 10. In general, the distending end 14 of the spring coil member 12 rests at about the end of the corresponding groove 24 upon substantially complete insertion of the spring coil member 12.

Figure 4:
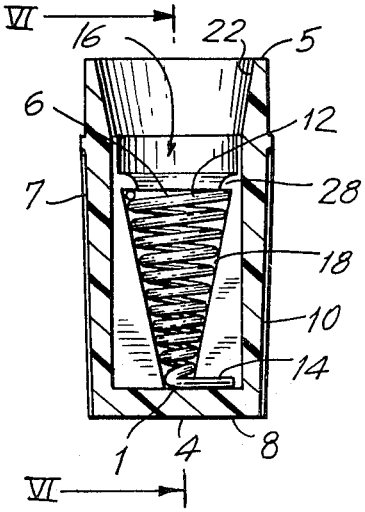
FIG. 4 is a sectional view of the thermoplastic member containing the tapered spring coil member after performance of the welding step.
Figure 6:
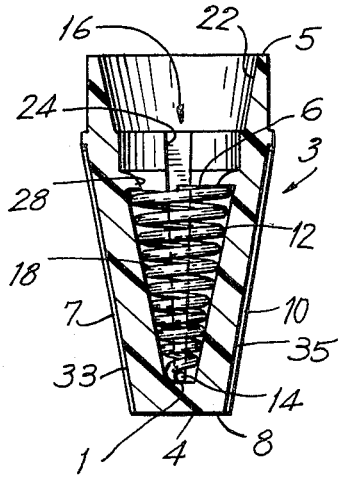
FIG. 6 is a sectional view of the assembly of FIG. 4 along section line VI—VI.

The inner side toward the open end of the thermoplastic member 10 is preferably provided with an about circular cross-section. The inner walls in this area are provided such that sufficient material is available for welding a protrusion 28 from the material of the thermoplastic member 10 as shown in FIGS. 4 and 6. Preferably the resulting protrusion 28 is a ring inside the thermoplastic member 10 at a desired position for retaining the spring coil member 12. The position of the protrusion 28 can be such that the spring member 12 is tightly fitted in the inner part of the thermoplastic member 10. Alternatively, the protrusion 28 can be positioned such that it allows for some play of the spring coil member 12 inside the thermoplastic member 10. Preferably, the thermoplastic member 10 before insertion of the spring coil member 12 comprises thermoplastic material for example as a circular edge near the position where the protrusion 28 is to be formed. Such an edge can be provided by a step in the inner contour of the thermoplastic member 10. The edge preferably continues into a cylindrical section with reference to the central axis of the thermoplastic member 10 until the point is reached where the tapered or conical section matching the spring coil member 12 starts.

After the insertion of the spring coil member 12, a welding process will move material from the edge to the desired protruding position.

As shown in FIGS. 5 and 7, the outer surface of the connector assembly 3 is like an elongated shell, preferably adapted to be easily gripped by fingers. For example, grooves 7 about parallel to the axis of the thermoplastic member 10 can be provided to avoid slippage of the connector assembly during the connecting of the wires. The outer form of the thermoplastic member 10 can be conical.

However, based on the two grooves 24, preferably the symmetry of the thermoplastic member 10 is considerably reduced as compared with rotary symmetry. The symmetry of the thermoplastic member 10 comprises essentially the central two-fold axis as well as two mirror planes going through the same axis and resulting in substantially the symmetry mm2 according to the international designation. This symmetry can also be advantageously provided for the outer surface of the thermoplastic member 10.

According to a preferred embodiment the cross-section of the closed end 8 of the thermoplastic member 10 corresponds to an elongated face such as provided for example by two semicircles connected to each other with straight lines. The outside surface can for example be approximated as a frustrum of a cone where however two planes have intersected forming two conical section surfaces passing through the straight lines connecting the semicircles. The resulting, about planar, surfaces provide the advantage of providing for grippers and/or fingers, a face for tightly holding and/or rotating the connector assembly around the wires to be connected.

The surface 22 is provided to guide the wires into the connector assembly as shown in FIGS. 1–4. Preferably this surface is slightly tapered to provide proper direction to the wires being inserted. The surface 22 of the inner part of the thermoplastic member 10 toward the base 5 is generally smooth or possibly provided with slight protrusions or recesses substantially lying in planes which also contain the center axis of the connector assembly 3 for properly directing the movement of the wires. Thus, the open end of the connector assembly 3 can be considered as a skirt to funnel the stripped ends of the wires into the spring coil member 12.

The connector assembly 3 is produced from conical spring coil members 12 having at their apices 1 a projecting end 14. The conical spring coil members 12 can be oriented with the aid of vibrators.

Raw nylon is molded to form the thermoplastic member 10, according to the present invention and the thermoplastic members 10 are also preferably oriented with the aid of vibrators. The thermoplastic members 10 are then placed in a position suitable for receiving the spring coil members 12. After insertion of the spring coil member 12, a weld is provided to form the protrusion 28 to retain the spring coil member 12 inside the thermoplastic member 10. Suitable welding methods include spin-welding, hot plate or thermal welding and ultrasonic welding with the latter being the preferred method.

Figure 3:
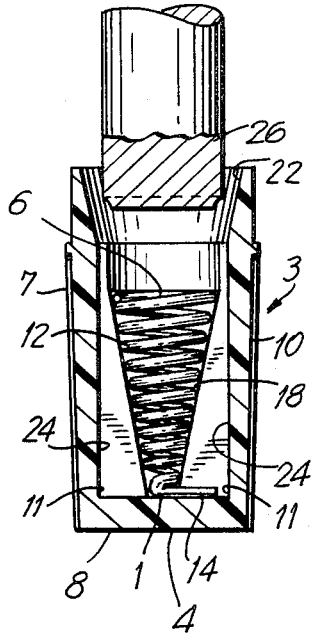
FIG. 3 is a sectional view of the thermoplastic member containing the tapered spring coil member with the approaching welding tool.

As shown in FIG. 3, an ultrasonic welding block with a pushing tool 26 is moved toward the thermoplastic member 10 and FIG. 4 shows the resulting protrusion 28 formed from transported welded thermoplastic material, which froze after the removal of the ultrasonic pushing tool 26.

The material transported by the pushing tool 26 must equal in volume the amount of material desired to form the stop ring protrusion 28 and it can be calculated from the diameters and the size of the protrusion 28 desired. It has to be considered that if an inadequate amount of material is used to form the protrusion 28 for the spring coil member 12, then the spring coil member 12 might pull out when the wires are to be connected and on the other hand too much material will close the opening of the thermoplastic member 10 and thereby limit the diameter of the bundle of strands that will be accepted by the connector assembly 3 to be fastened by the spring coil member 12.

Referring now to FIG. 5, there is shown a top view of an embodiment of the connector assembly 3 of the present invention. The elongated cross-section of the closed end of the thermoplastic member 10 can be recognized. The faces 33 and 35 for gripping the connector assembly are shown as well as ribs 37, which provide additional safeguards against slippage upon fastening the connector assembly to the wires to be connected.

FIG. 6 shows a cross-section of the connector assembly and the convergence of the outer faces 33 and 35 to the narrow part of the closed end 8.

The tapered spring coil member 12 is nested inside of the thermoplastic member 10 and retained by protrusion 28.

FIG. 7 shows an elevational view of the thermoplastic member 10. The area 51 corresponds approximately to the skirt of the thermoplastic member and area 53 corresponds about to the inner region where the tapered spring coil member 12 is held.

FIG. 8 shows part of an embodiment with area 51 and area 53 of the thermoplastic member 10. A cross-section of the tapered spring coil member 12 is indicated at 59. The hatched area 61 corresponds to the volume which is to be transferred by ultrasonic welding. FIG. 9 corresponds to FIG 8, however, the thermoplastic member 10 as shown in FIGS. 1–7 is now shown as resulting after the ultrasonic welding step. The material of the hatched area 61 in FIG. 8 has been transferred to the nose 63, restraining the base section 6 of the tapered spring coil member 12. The volume of the material transferred remains the same after displacement as it was before the displacement. However, its shape changes considerably during the displacement induced by the ultrasonic pushing tool 26, whose tip is configured to melt and roll the thermoplastic material during its travel along the longitudinal axis of the thermoplastic member 10.

The momentum of the cross-section mass of thermoplastic material transferred with respect to the central axis of the thermoplastic member 10 after displacement carries the mass beyond the push of the pushing tool 26. Thus radially inward displacement directed toward the central axis results in a lengthening of the cross-section of the transferred material and consequently a travel toward the base 6 of the spring coil member 12. The transferred material can surround the wire at the base 6 of the spring coil member 12 under formation of an about semicircular contacting surface. It is seen that the thus formed nose 63 will prevent removal of the tapered spring coil member 12 from the thermoplastic member 10.

The curved outside end of the nose 63 will guide the strands of wire such as copper wire into the converging tapered spring coil member 12, while preventing at the same time the separation of the spring coil member 12 from the thermoplastic member 10.

In general, the welding step causes a decrease of the tensile strength of the material subjected to the welding step versus the tensile strength of the non-welded bulk volume of the thermoplastic member 10 of for example from about 10 to 50 percent. At the same time an increase in brittleness of for example from about 10 to 50 percent can occur. The presence of humidity during the welding process increases the degradation of the tensile strength values and increases the brittleness.

Various test procedures can be incorporated in the production process of the connector assembly. For example, the thermoplastic member 10 with the inserted spring members can be tested before and after the welding step and rejects can be separated from the production material which meet standards set in advance. Advantageously, the production process can be run in a straight assembly line such as provided for example in connection with the use of an index table.

Having described specific embodiments of the invention with respect to the accompanying drawings, it is to be understood that the invention is not limited to those precise embodiments, and that various changes and modifications may be effected therein by one skilled in the art without departing from the scope or spirit of the invention as defined in the appended claims.

I claim:

1. A nylon connector assembly for metallic wires comprising:

a tapered spring coil member of stiff wire having a distended end at its apex projecting to the outside of said member in a direction in a plane vertical to the coil axis, said tapered spring coil member in a conical configuration, and said distended end comprising a short straight portion of said spring coil member's wire;

a nylon thermoplastic member having an elongated shell with a central bore, said bore having two ends, said bore closed at one end by an end wall and open at its other end, said open end of said bore substantially circular, the inside of said bore substantially tapered and adapted to house said tapered spring coil member, two grooves in the tapered inside wall of said bore, said grooves disposed substantially beginning nearest to the largest diameter of said taper of said bore coinciding with the wide base of said spring coil member within a plane passing through the central axis of said bore, and said grooves adapted to provide space and guidance during insertion and locking for said distended end of said tapered spring coil member, said closed end of said bore having a substantially elongated form, the outside wall of the nylon thermoplastic member near said closed end wall substantially corresponding to a surface generated by straight lines connecting the substantially circular bore opening and the elongated form of the end wall, providing a gripping surface on said thermoplastic member; and a protrusion provided after the insertion of said coil spring member near said open end of said bore, said protrusion comprising a frozen ultrasonic weld line so shaped and dimensioned to retain a prior inserted tapered spring coil member at its wide base whereby said tapered coil spring is undislodgeable from said bore.

2. The connector assembly for metallic wires according to claim 1 wherein the longest dimension of said elongated shell corresponds to nearly the diameter of said substantially circular opening.

3. The connector assembly for metallic wires according to claim 1 wherein the elongated shell said outside wall near said closed end wall substantially corresponds to two semicircles in a plane connected by straight connecting lines.

4. The connector assembly for metallic wires according to claim 1 wherein central bore of said thermoplastic member has a conical taper.

5. The connector assembly for metallic wires according to claim 1 wherein said protrusion retains said tapered spring coil member in a fixed position.

6. The connector assembly for metallic wires according to claim 1 wherein said protrusion retains the tapered spring coil member in a loose position.

7. The connector assembly for metallic wires according to claim 1 wherein no more than two recesses are provided.

8. The connector assembly for metallic wires according to claim 1 wherein the tensile strength of the thermoplastic material in the area of said protrusion is from about 10 to 50 percent less than in the bulk of the thermoplastic member.

9. The connector assembly for metallic wires according to claim 1 wherein the brittleness of the material in the area of said protrusion is from about 10 to 50 percent higher than in the bulk of the thermoplastic member.

10. The connector assembly for metallic wires according to claim 1 wherein said protrusion is a ring inside said thermoplastic member disposed at a position distant from the open end of said thermoplastic member by from about 0.1 to 0.3 times the total length of said thermoplastic member.

11. The connector assembly for metallic wires according to claim 1 wherein said thermoplastic member of the connector assembly exhibits substantially mm2 symmetry.

* * * * *